US006349763B1

(12) United States Patent
Estep et al.

(10) Patent No.: US 6,349,763 B1
(45) Date of Patent: Feb. 26, 2002

(54) ELECTRICAL SURFACE ACTIVATED DOWNHOLE CIRCULATING SUB

(75) Inventors: James W. Estep, Houston; Albert Odell, Kingwood; Harold D. Johnson, Houston, all of TX (US)

(73) Assignee: Halliburton Energy Services, Inc.

( * ) Notice: Subject to any disclaimer, the term of this patent is extended or adjusted under 35 U.S.C. 154(b) by 0 days.

(21) Appl. No.: 09/377,982

(22) Filed: Aug. 20, 1999

(51) Int. Cl.[7] ..... E21B 27/00; E21B 41/00
(52) U.S. Cl. ..... 166/66.4; 175/232; 175/234
(58) Field of Search ..... 175/231, 232, 175/234, 317; 166/65.1, 66.4, 66.6, 66.7

(56) References Cited

U.S. PATENT DOCUMENTS 3,907,046 A * 9/1975 Gaylord ..... 175/317
4,129,184 A * 12/1978 Parker ..... 166/66.6
4,373,582 A * 2/1983 Bednar et al. ..... 166/65.1
4,632,193 A * 12/1986 Geczy ..... 175/317
5,465,787 A * 11/1995 Roth ..... 166/66.4

* cited by examiner

*Primary Examiner*—William Neuder
(74) *Attorney, Agent, or Firm*—Conley, Rose & Tayon, P.C.

(57) ABSTRACT

A preferred novel circulating sub includes an electric motor, hydraulic intensifier, connecting rod, valve sleeve, valve plug, and angled nozzles. Upon activation of the circulating sub the electric motor drives the valve sleeve over the valve plug, causing a flow of drilling fluid to exit the angled nozzles. Upon deactivation of the circulating sub, the electric motor removes the valve sleeve from the valve plug, allowing the flow of drilling fluid to once again flow to the drill bit. Because the electric motor is reversible, the circulating sub can be repeatedly activated and deactivated.

12 Claims, 8 Drawing Sheets

ELECTRICAL SURFACE ACTIVATED DOWNHOLE CIRCULATING SUB

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention relates generally to downhole circulation subs. More particularly, this invention relates to the use of an electric motor to drive a downhole circulation sub.

Retrieval of oil and other hydrocarbons form below ground typically includes drilling a borehole, also known as a wellbore, in the Earth. As drilling technology has advanced, these boreholes may be drilled off of vertical, sometimes even sideways or horizontal. In this way, an operator can reach a formation that contains the desired substance. Thus, the terms "upper" and "lower", or "above" and "below" as used herein are made with respect to a position in the borehole, and may not necessarily reflect whether two elements are above or below each other in an absolute sense. FIG. 1 includes rock formation 100 surrounding a borehole 110. Borehole 100 is formed by the cutting action of drill bit 125 attached to rotating drill string 120. Drill string 120 also includes a circulating sub 170.

A variety of drill bits 125 are known, but a common feature is that each contains ports or nozzles on its face to direct drilling mud 130 (also known as drilling fluid) flowing through drill string 120. The drilling mud 130 exits the drill bit as shown by arrows 160. This mud not only cools the face of the drill bit, but also carries to the surface a substantial amount of shavings and cuttings 140 that result from the drilling action. These cuttings are carried up to the surface from downhole along an area between the drillstring and the borehole wall known as the annulus 150. At the surface, the drilling mud is then cleaned, filtered and recycled for repeated use.

One problem occurs when the ports or nozzles on the face of the drill bit 125 become blocked or otherwise impeded from spraying drilling mud out the face of the drill bit 160. This prevents or substantially slows the flow of mud to the surface, resulting in the rock cuttings falling to the bottom of the wellbore. It also results in a pressure build-up in the mud contained in the drill string. The increase in pressure can damage equipment uphole such as pumps. To minimize this problem, it is known to provide a circulating sub 170 that provides an alternate route 165 for drilling mud flow when the mud is unable to exit drill bit 160 properly.

Referring to FIG. 2, a known circulating sub 200 is called a ball-drop circulating sub. It includes a cylindrical valve sleeve 210 having holes or ports 220. At its lower end is a lip 230 that reduces the inner diameter of the cylindrical valve sleeve 210. The circulating sub housing surrounds valve sleeve 210 and also includes ports 225. Shoulder 260 is positioned for abutment against the lower portion of valve sleeve 210, as explained below. Between valve sleeve 210 and drill string 120 are o-rings 240–242 and a shear pin 250. Ball 270 is shown falling in mid-travel from the surface before lodging in area formed by lip 230.

During normal operation (i.e., when mud is properly flowing 160 through the drill bit 125), drilling, mud 130 flows through the center of circulating sub 200 as shown by arrows 280. However, upon a blockage in the flow of mud, a ball 270 is shot from the surface down to ball-drop circulating sub 200. Ball 270 lodges against lip 230, preventing the flow of mud 130 along flow path 280. Pressure built up in the mud column exerts itself against ball 270 and causes shear pin 250 to break. Valve sleeve 210 drops down until stopped by shoulder 260. This aligns ports or holes 220 and 225. Drilling mud 130 then escapes circulating sub 200 and follows mud path 165 (shown in FIG. 1) to the surface. This lifts the rock cuttings above the circulating sub 200 to the surface. However, the ball-drop circulating subs have a number of problems. For example, because the ball 270 originates at the surface, it can take up to thirty minutes from the time the mud flow stops through a drill bit to the time the circulating sub redirects the flow. In addition, this design is a one-time actuation and cannot be reset.

Other circulating subs having various problems, such as U.S. Pat. No. 5,465,787, are also presently known.

SUMMARY OF THE INVENTION

A preferred embodiment of the present invention features a downhole circulation sub having an electric motor associated with a valve poppet. The valve poppet moves from a first position to a second position in response to force from the electric motor, causing drilling fluid flowing through the circulation sub to switch its path of travel from a first route generally downwhole to a second route generally uphole. In its second position, the valve sleeve may engage a valve plug. Further, the valve poppet may be placed back in its first position by operation of the electric motor. The circulation sub is designed so that this movement of the valve sleeve from its first to its second position, and back again, may be carried out repeatedly.

Another aspect to the invention is a method of redirecting the flow of drilling fluid in a circulation sub. This aspect of the invention includes actuating an electric motor to apply force to a connected valve sleeve, moving the valve sleeve from a first position inside a housing to a second position by actuation of the electric motor, preventing by movement of the valve sleeve to the second position the flow of fluid past a lower end of the circulation sub, and directing by the movement of the valve sleeve to the second position the flow of fluid through ports positioned between the valve sleeve and an annulus. The first position is typically an upper position with respect to a wellbore, and the second position is a lower position.

Thus, the present invention comprises a combination of features and advantages which enable it to overcome various problems of prior devices. The various characteristics described above, as well as other features, will be readily apparent to those skilled in the art upon reading the following detailed description of the preferred embodiments of the invention, and by referring to the accompanying drawings.

BRIEF DESCRIPTION OF THE DRAWINGS

For a more detailed description of the preferred embodiment of the present invention, reference will now be made to the accompanying drawings, wherein.

DETAILED DESCRIPTION OF THE PREFERRED EMBODIMENT

Figure 1:
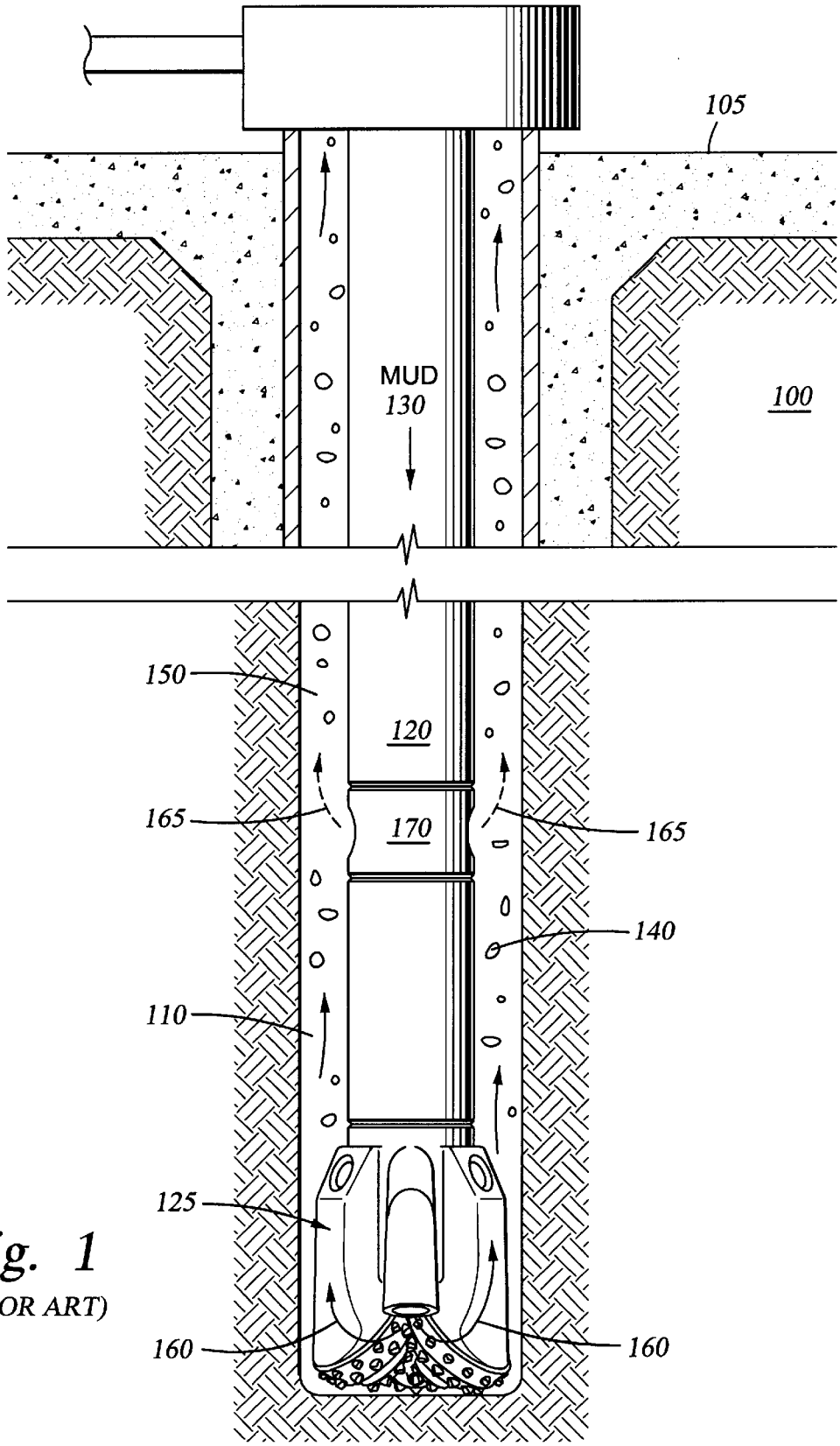
Fig. 1 (PRIOR ART)
FIG. 1 illustrates the typical flow of drilling fluid in a borehole.
Figure 2:
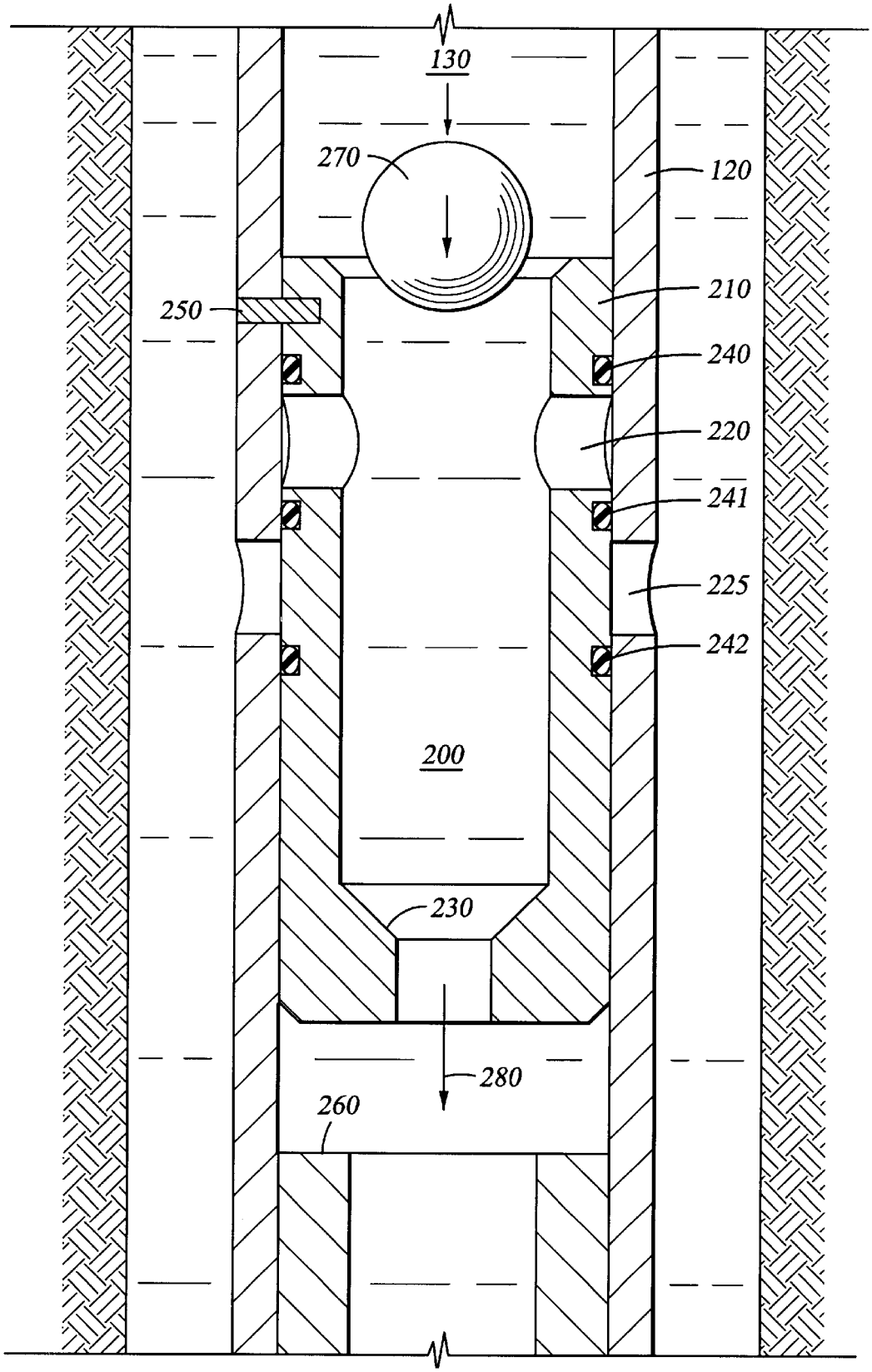
FIG. 2 depicts the operation of a ball drop circulating sub.
Figure 3A:
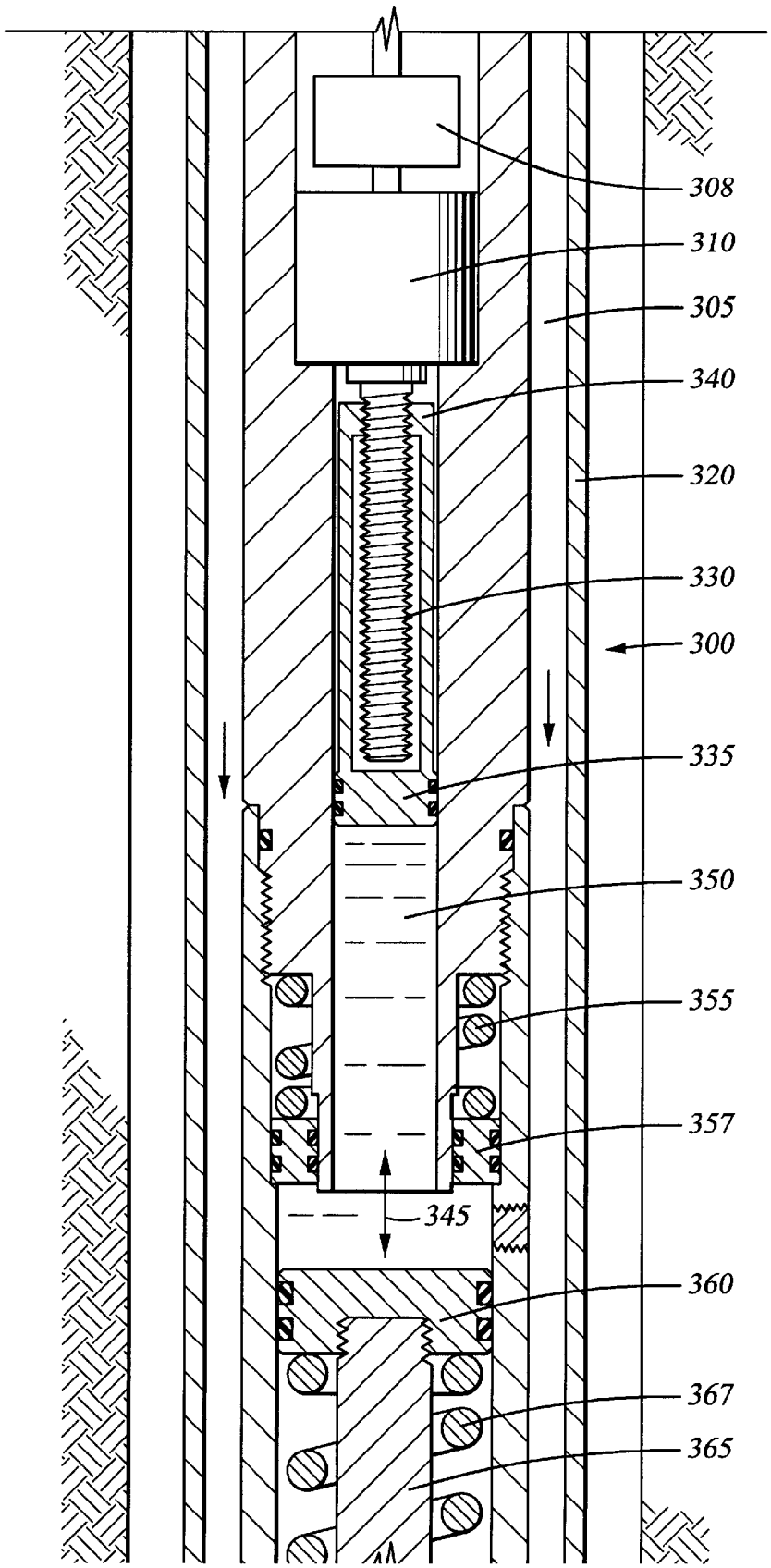
FIGS. 3A and 3B is a cut-away view of the preferred embodiment of the invention.
Figure 3B:
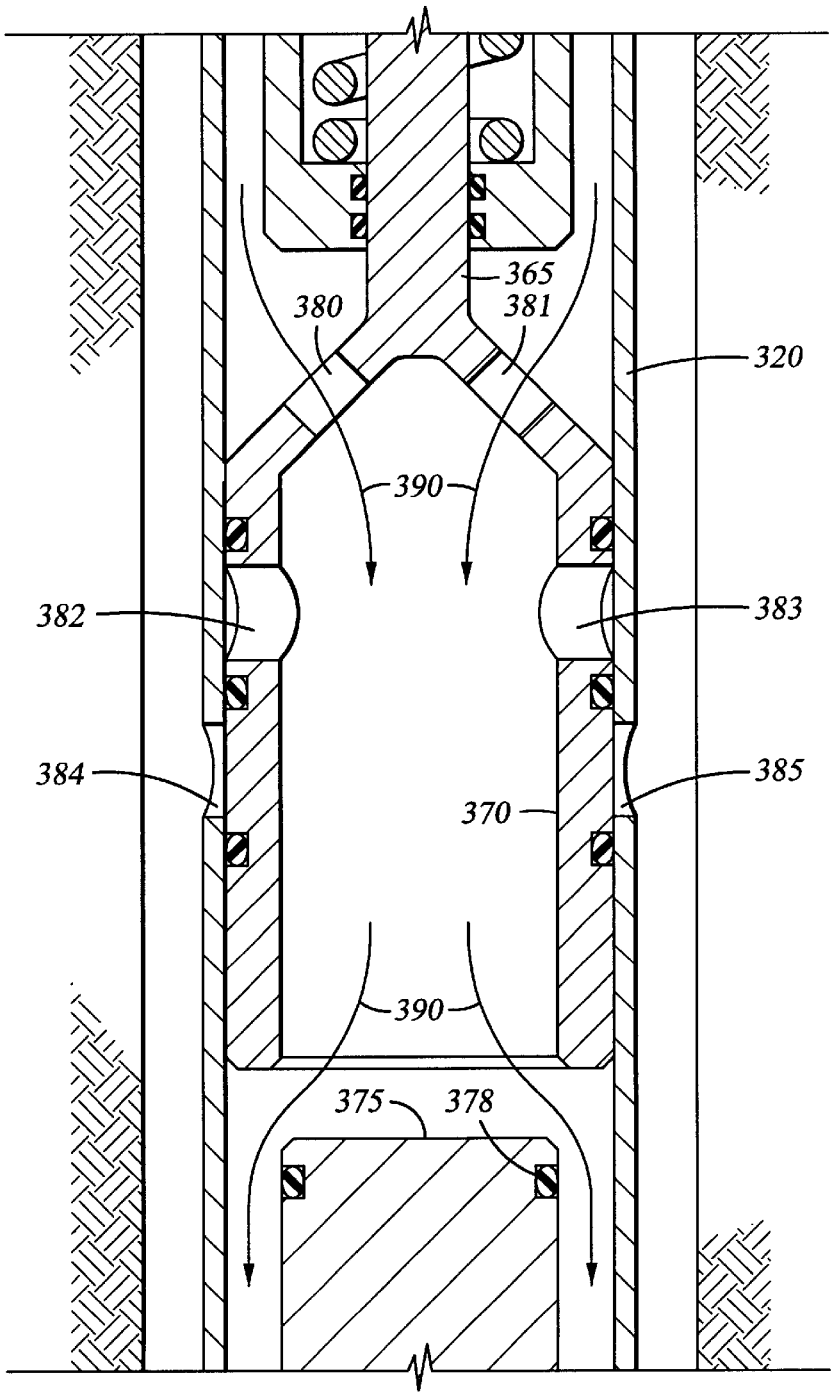

FIGS. 3A and 3B generally show the operation of the preferred embodiment. A fluid circulating sub 300 according to the preferred embodiment is attached to drill string or other housing 320. The circulating sub 300 includes a DC motor 310 with associated downhole circulating sub electronics 308, the DC motor 310 being mechanically coupled to rotate threaded screw 330 in either direction. Nut 340 terminates in piston 335. Nut 340 threadably affixes to screw 330, and moves laterally as shown by arrow 345 upon the rotation of the screw by motor 310. Chamber 350 terminates at its narrow end at piston 335 and at its wide end at piston 360. Piston 360 connects to connecting rod 365. Also shown in FIG. 3A are mud passage 305 around the perimeter of the circulating sub, oil compensation spring 355, oil compensation piston 357, and fail-sate spring 367.

FIG. 3B also illustrates drillstring 320 and connecting rod 365. Additionally shown are valve sleeve 370, also known as a valve poppet, formed to sealably engage valve seat 375. Valve seat 375, also called a valve plug, may be mounted by use of a screw, for example, and includes an o-ring 378 to form a seal with valve sleeve 270. Holes 380 and 381 for mud flow 390 into the center of the circulating sub are formed in the upper portion of valve sleeve 370. Holes 382 and 383 in valve sleeve 370 correspond to holes 384 and 385 in the housing and provide an alternate route for the drilling mud when the circulating sub is open and activated. The housing is a circulating sub housing that engages with the valve sleeve, but may be any appropriate housing such as a section of the drill string. In addition, many of the advantages of the preferred embodiment may still be obtained even where the valve poppet is not exactly like the configuration shown. The valve poppet can therefore be any of a variety of configurations.

During operation, downhole circulating sub electronics 308 receive power from the surface. To facilitate power delivery, the system may be preferably part of a coiled tubing drillstring equipped with electric wiring. Alternatively, the system may be part of a slim-hole jointed drill pipe string, for example, or may be any other structure suitable to deliver power downhole. Real-time data communications from the surface are also sent to the downhole circulating sub electronics. In response, the electronics 308 control the operation of electric motor 310. Electric motor 310 is preferably a DC motor, although this is not crucial to the invention. The electric actuation motor 310 is reversible and may turn screw 330 in either direction to repeatedly open and close the circulating sub 300. As such, the circulating sub disclosed herein has a longer life span than circulating subs known in the prior art. It also does not require replacement when the drillstring is "tripped", or removed from the well bore. It is therefore more economical than circulating subs known in the prior art.

As electric motor 310 turns screw 330, the nut 340 moves laterally 345 by force of threaded screw 330. This moves piston 335 within chamber 350. Chamber 350 includes both a smaller cross-sectional end for piston 335 and a larger cross-sectional end for piston 360. As screw 330 is actuated (i.e., moves from left to right in FIG. 3B), it applies force to clean hydraulic fluid filling chamber 350. This fluid transmits the force from piston 335 to piston 360. What results is a hydraulic intensifier requiring less torque from, and thus less instantaneous current for, DC motor 310. As force is applied to piston 360, connecting rod 365 moves laterally in opposition to fail-safe spring 367. In case of power failure, fail-safe spring returns the connecting rod 365, and hence the circulating sub, to its unactuated and closed position.

Surrounding chamber 350 is an oil compression spring to resist the collapsing force from the drilling mud under high pressure and traveling through passage 305. Oil compensation piston 357 accounts for the expansion and contraction of the hydraulic fluid due to temperature variations.

When valve sleeve is in its unactuated position as shown in FIG. 3B, drilling mud flows through holes 380 and 381 and follows mud path 390 past valve seat 375 and down to a drill bit, where it exits and travels up to the surface. The movement of connecting rod 365 from left to right opens the circulating sub by movement of valve sleeve 370.

When this occurs, valve sleeve 370 covers and seals with valve seat 375 by, for example o-ring seal 378. This movement of the valve sleeve aligns holes 383 and 385, and holes 382 and 384, respectively, to provide an alternate mud flow path to the annulus. This alternate mud flow path bypasses the downhole drill bit and provides direct access to the annulus for the drilling fluid. It would now be apparent to the artisan of ordinary skill that the valve plug need not necessarily engage within the valve sleeve exactly as shown, but rather that other appropriate geometries and structures could be used, so long as the valve sleeve engages to prevent flow of drilling fluid past the circulation sub.

Figure 4A:
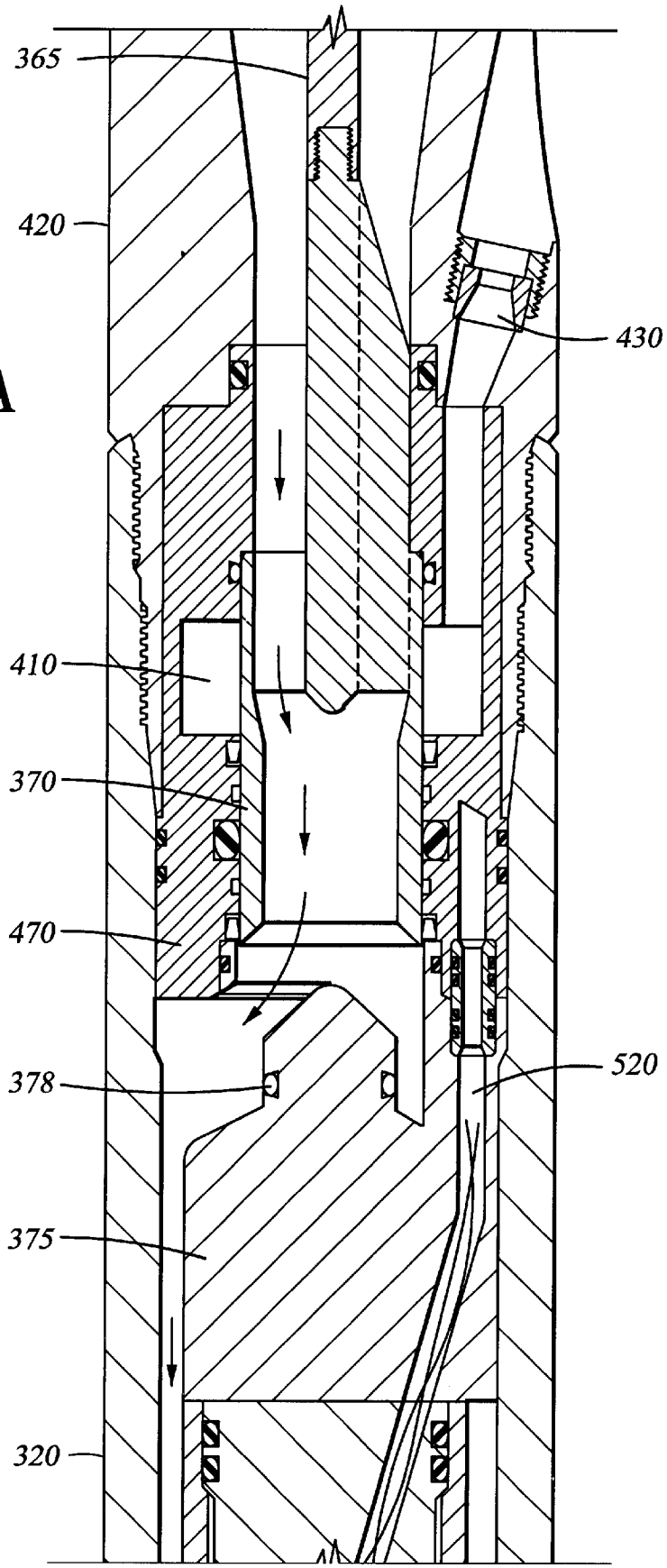
FIG. 4A is a cut-away view of the valve sleeve of the preferred embodiment in a closed position.
Figure 4B:
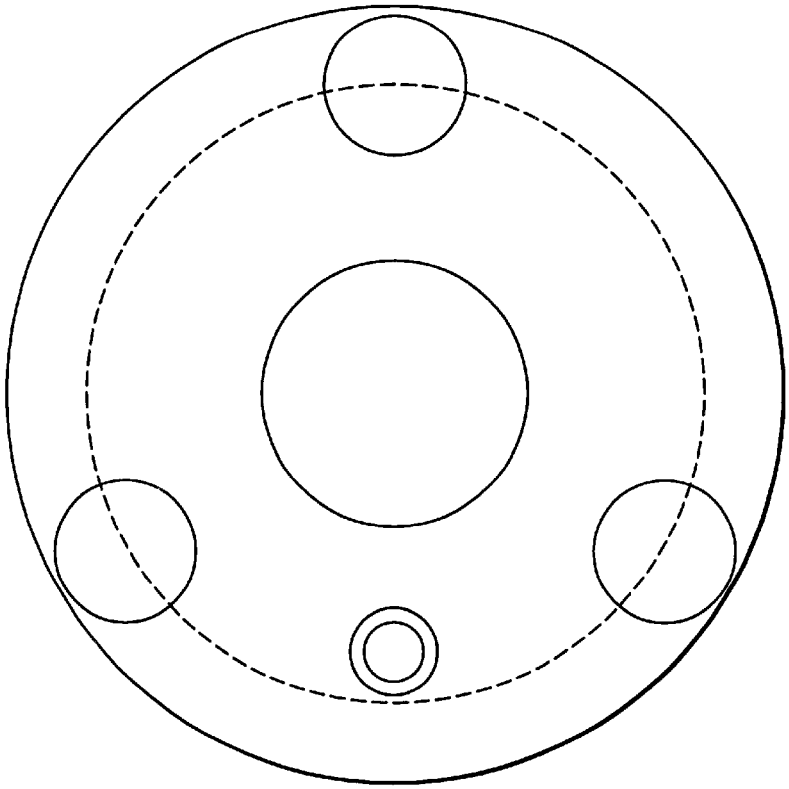
FIG. 4B is taken along line A—A of FIG. 4A.

FIG. 4A includes a connecting rod 365 that connects to sliding sleeve valve 370. Sleeve valve 370 resides in nozzle sub 420 and lower sub 320. Valve body 470 includes a bypass chamber 410 and wire channel 520, as well as containing plug valve 275. Sleeve valve 370 prevents the flow of mud into the bypass chamber 410 and forces the flow of drilling mud 390 past valve plug 375 toward a downhole assembly. Wires in wire channel 520 supply power downhole. Thus, like FIG. 3, FIG. 4A depicts the valve assembly in a closed position. FIG. 4B is taken along line A—A of FIG. 4A.

Figure 5:
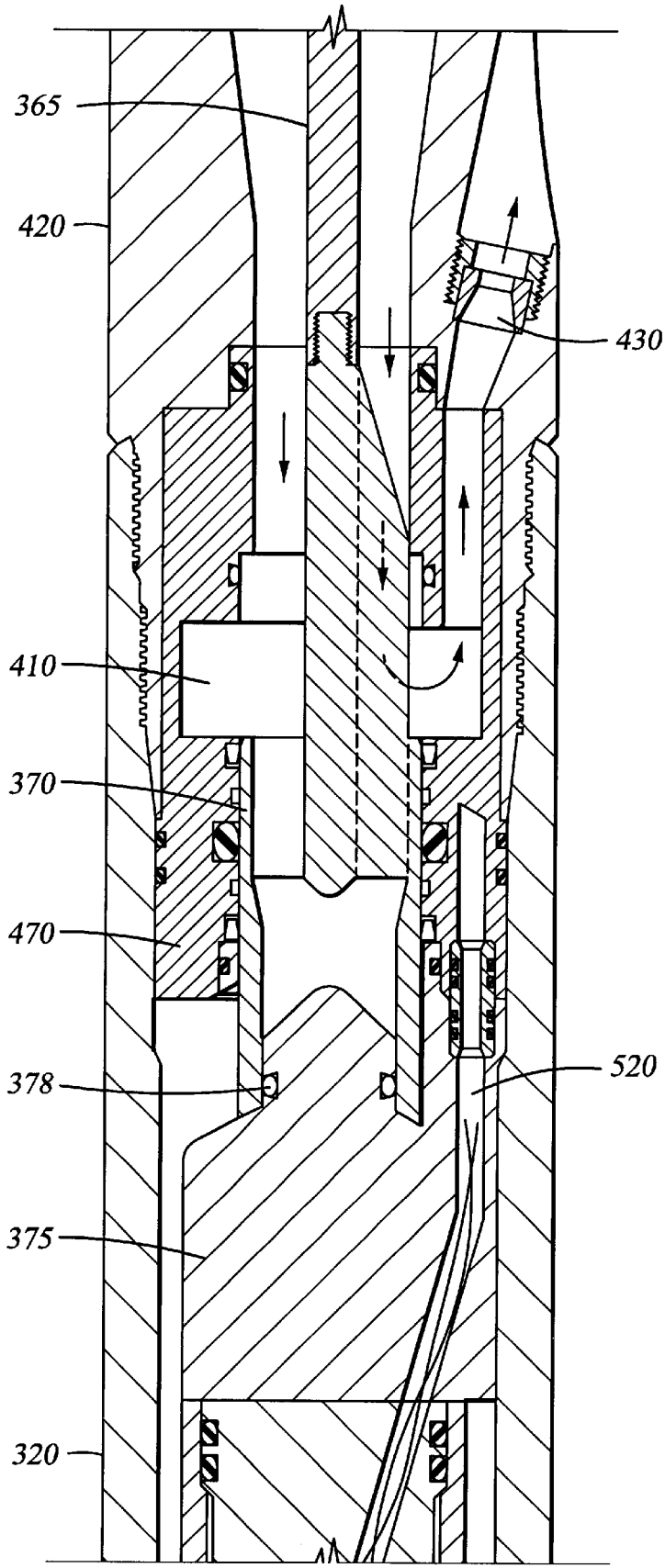
FIG. 5 is a cut-away view of the valve sleeve of the preferred embodiment in an open position.

FIG. 5 shows the valve assembly in an open position. Connecting, rod 365 attaches to sliding sleeve valve 370. A seal between these two components is made by o-ring seal 378. As can be seen, mud flow is prevented from going past valve plug 375 and instead is directed to bypass chamber 410 and out replaceable nozzles 430. These nozzles 430 are angularly mounted with the centerline, creating a spiraling fluid stream that is effective to lift and transport cuttings out of the borehole for hole cleaning purposes. Further, because all bore fluid flow is cut off from the lower port of the bottomhole assembly, all of the drilling mud is forced to circulate to the annular region between the drillstring and the borehole wall. This results in the cuttings in the borehole above the circulating sub being circulated to the surface (where they can be cleaned from the drilling fluid) prior to the tripping or removal of the drill string from the borehole.

Figure 6:
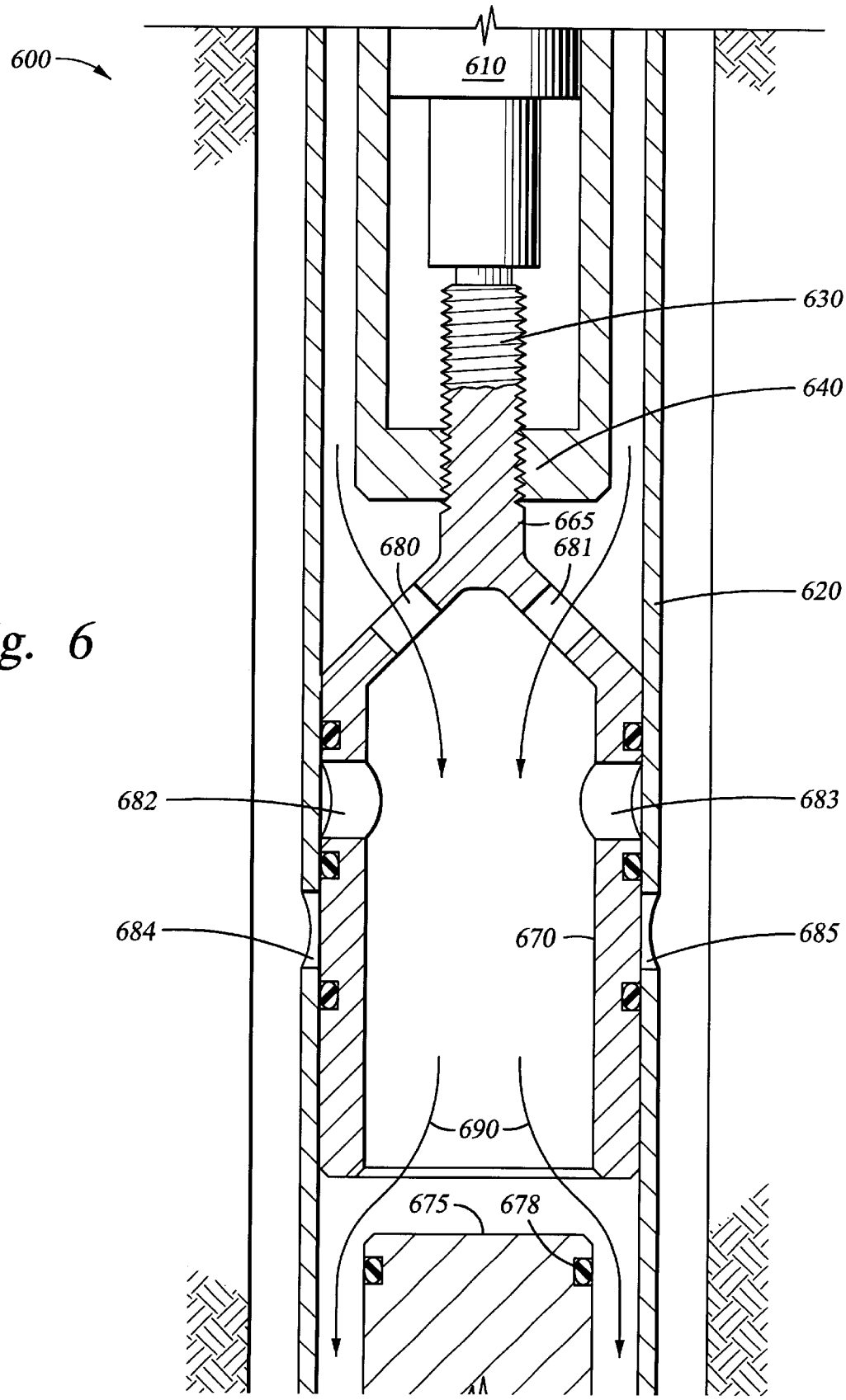
FIG. 6 is a cut-away diagram of a second embodiment of the invention.

FIG. 6 illustrates a second embodiment of the invention. This circulating sub 600 includes an electric motor 610 attached to a lead screw 630. The lead screw 630 attaches to a valve sleeve 670. Hence, this embodiment does not use hydraulic force amplification. Instead, this embodiment uses direct mechanical actuation involving the advancing and retracting of a lead screw 630 by the electric motor 610, the lead screw opening and closing the valve sleeve 670.

Figure 7:
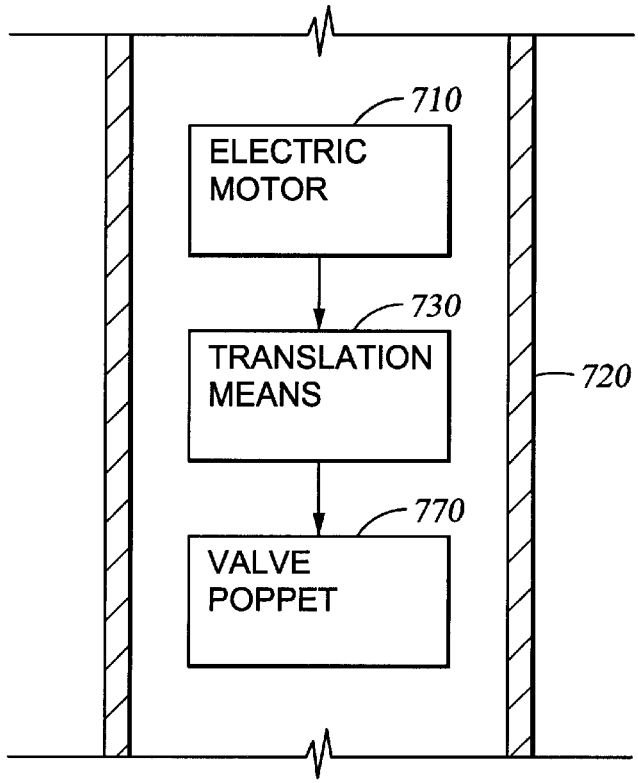
FIG. 7 is a block diagram of a third embodiment of the invention.

FIG. 7 illustrates a third embodiment of this invention that does not include a connecting rod to associate the electric motor to the valve sleeve. An assembly inside a housing 720 includes an electric motor 710 associated with a valve poppet 770. A translation means 730 applies from the electric motor 710 to the valve poppet 770. Thus, a non-mechanical linkage, such as a hydraulic arrangement, may be used as the translation means 730 to open and close the downhole valve poppet 770 by operation of the electric motor 710.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly the scope of protection is not limited to the embodiments described herein, but is only limited by the claims that follow, the scope of which shall include all equivalents of the subject matter of the claims.

What is claimed is:

1. A circulation sub suitable to direct a flow of fluid, said circulation sub comprising:

an electric motor;

a housing;

a valve poppet being associated with said electric motor such that application of force by said electric motor to said valve poppet moves said valve poppet from a first position to a second position with respect to said housing;

a valve plug attached to said housing, said valve plug being sealably engaged with said valve poppet upon said valve poppet attaining said second position;

wherein said flow of fluid through said circulation sub travels a first route when said valve poppet is in said first position and travels a second route when said valve poppet is in said second position.

2. A circulation sub suitable to direct a flow of fluid, said circulation sub comprising:

a housing;

an electric motor;

a valve poppet being associated with said electric motor such that application of force by said electric motor to said valve poppet moves said valve poppet from a first position to a second position with respect to said housing;

a screw attached directly to said electric motor, said screw including a nut;

said nut terminating in a first piston housed in a chamber;

a second piston in communication with said chamber, said second piston attaching to said valve poppet; and a liquid in said chamber suitable to communicate forces from said first piston to said second piston;

wherein said flow of fluid through said circulation sub travels a first route when said valve poppet is in said first position and travels a second route when said valve poppet is in said second position.

3. A circulation sub suitable to direct a flow of fluid, said circulation sub comprising:

an electric motor;

a housing;

a screw attached directly to said electric motor, said screw including a nut;

said nut terminating in a first piston housed in a chamber, wherein said chamber has a first end and a second end, said first end of said chamber having a smaller area than said second end;

a valve poppet being associated with said electric motor such that application of force by said electric motor to said valve poppet moves said valve poppet from a first position to a second position with respect to said housing; and a second piston in communication with chamber, said second piston attaching to said valve poppet;

wherein said flow of fluid through said circulation sub travels a first route when said valve poppet is in said first position and travels a second route when said valve poppet is in said second position.

4. A circulation sub suitable to direct a flow of fluid, said circulation sub comprising:

an electric motor;

a housing;

a valve poppet being associated with said electric motor such that application of force by said electric motor to said valve poppet moves said valve poppet from a first position to a second position with respect to said housing; and a connecting rod attached to said electric motor and attached to said sliding valve sleeve, said connecting rod communicating said force from said electric motor to said valve poppet wherein said flow of fluid through said circulation sub travels a first route when said valve poppet is in said first position and travels a second route when said valve poppet is in said second position.

5. A method of redirecting the flow of drilling fluid in a circulation sub, comprising:

(a) actuating an electric motor to apply force to a connected valve sleeve, said valve sleeve having a first end and a second end;

(b) moving said valve sleeve from a first position inside a cylindrical housing to a second position inside said cylindrical housing by said actuation of said electric motor;

(c) preventing by said moving of said valve sleeve to said second position the flow of fluid past a second end of said valve sleeve.

6. The method of claim 5, further comprising:

(d) directing by said moving of said valve sleeve to said second position the flow of said fluid through ports positioned generally between said valve sleeve and an annulus.

7. The method of claim 6, wherein said first position is an upper position with respect to a wellbore and said second position is a lower position.

8. The method of claim 6, wherein said moving of said valve sleeve to said second position engages said valve sleeve with a valve plug, said flow of fluid traveling past said valve when said valve sleeve is in said first position.

9. The method of claim 6, wherein said electric motor applies torque to an attached screw, said screw applying force to said valve sleeve to move said valve sleeve from said first to said second position.

10. The method of claim 6, further comprising:

(e) moving said valve sleeve from said second position to said first position by said electric motor.

11. The method of claim 6, wherein said electric motor applies torque to an attached screw, said screw applying force to said valve sleeve to move said valve sleeve from said first to said second position and further including a fluid-filled chamber having a first end with a first cross-sectional area and a second end with a second cross-sectional area, said second cross-sectional area being larger than said first cross-sectional area, said fluid-filled chamber being interposed between said screw and said valve sleeve.

12. A method of redirecting the flow of drilling fluid in a circulation sub, comprising:

(a) actuating an electric motor to apply force to a connected valve sleeve, said valve sleeve having a first end and a second end;

(b) moving said valve sleeve from a first position inside a cylindrical housing to a second position inside said cylindrical housing by said actuation of said electric motor, said electric motor applying torque to an attached screw, said screw applying force to said valve sleeve to move said valve sleeve from said first to said second position, wherein a fluid filled chamber is interposed between said valve sleeve and said electric motor, said chamber having ends of different cross-sectional areas;

(c) preventing by said moving of said valve sleeve to said second position the flow of fluid past a second end of said valve sleeve;

(d) directing by said moving of said valve sleeve to said second position the flow of said fluid through ports positioned generally between said valve sleeve and an annulus.

* * * * *